US010486453B2

(12) United States Patent
Lien et al.

(10) Patent No.: US 10,486,453 B2
(45) **Date of Patent: *Nov. 26, 2019**

(54) GREETING CARD HAVING AUDIO RECORDING CAPABILITIES WITH TRIAL MODE FEATURE

(71) Applicant: HALLMARK CARDS, INCORPORATED, Kansas City, MO (US)

(72) Inventors: Timothy J. Lien, Shawnee, KS (US); Randy S. Knipp, Kansas City, MO (US); John B. Watkins, Independence, MO (US)

(73) Assignee: Hallmark Card, Incorporated, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/126,815

(22) Filed: Sep. 10, 2018

(65) Prior Publication Data

US 2019/0001731 A1 Jan. 3, 2019

Related U.S. Application Data

(63) Continuation of application No. 12/101,789, filed on Apr. 11, 2008, now Pat. No. 10,071,590.

(51) Int. Cl.
*G10L 21/00* (2013.01)
*B42D 15/02* (2006.01)

(52) U.S. Cl.
CPC ..... *B42D 15/022* (2013.01)

(58) Field of Classification Search
CPC ..... G10L 21/00
(Continued)

(56) References Cited

U.S. PATENT DOCUMENTS 3,798,806 A 3/1974 Sanford
4,611,262 A 9/1986 Galloway et al.
(Continued)

FOREIGN PATENT DOCUMENTS

CA 1278862 C 1/1991
DE 3532259 A1 3/1987

OTHER PUBLICATIONS

Land's End—Recordable Gilt Card Carrier, at least as early as Jun. 27, 2007.
Winbod—Information Manual for ISD18B12—Aug. 17, 2007.

*Primary Examiner* — Michael C Colucci
(74) *Attorney, Agent, or Firm* — Shook, Hardy & Bacon L.L.P.

(57) ABSTRACT

A greeting card having an audio message recording and playback device permits recording of personalized audio messages to be played upon opening of the greeting card. The recording device is operable in either a trial mode or a use mode. In the trial mode, which would be applicable when the card is displayed in a store, a potential purchaser may experience the functionality of the card by recording their own test message. The test message is played back initially for the potential purchaser but is not subsequently played back to be later heard by other potential purchasers. In the use mode, which the card may be switched to after purchase by removal of a trial mode panel from the greeting card, a user recorded message is played repeatedly upon subsequent openings of the card. The user recorded message may be followed by a prerecorded recording, such as a song. Additional prerecorded messages, such as voice prompts with instructions for recording a message, may also be included.

20 Claims, 4 Drawing Sheets

(58) Field of Classification Search
USPC ..... 704/9, 272, 270; 434/319, 308, 317; 379/88.23, 88.07, 67.1
See application file for complete search history.

(56) References Cited

U.S. PATENT DOCUMENTS 4,677,657 A 6/1987 Nagata et al.
4,791,741 A * 12/1988 Kondo ..... B42D 15/022 283/117
5,045,327 A * 9/1991 Tarlow ..... G11C 7/16 281/51
5,063,698 A * 11/1991 Johnson ..... B42D 15/022 379/75
5,232,087 A 8/1993 Schluger
5,251,251 A 10/1993 Barber et al.
5,387,108 A * 2/1995 Crowell ..... B42D 15/022 40/124.01
5,425,078 A * 6/1995 Stern ..... H04M 3/533 379/88.23
5,444,767 A 8/1995 Goetcheus et al.
5,502,463 A * 3/1996 Sasaki ..... B42D 15/022 345/204
5,513,117 A 4/1996 Small
5,652,606 A 7/1997 Sasaki et al.
5,719,920 A * 2/1998 Harman ..... G09F 25/00 379/88.07
5,812,899 A * 9/1998 McIntyre ..... G03B 17/24 396/661
5,860,065 A * 1/1999 Hsu ..... G10H 1/26 40/124.03
6,028,752 A 2/2000 Chomette et al.
6,030,274 A 2/2000 Kaplan
6,104,306 A * 8/2000 Hogue ..... B42D 15/022 200/332
6,158,588 A 12/2000 Conti
6,253,183 B1 6/2001 Boucard
6,282,819 B1 9/2001 Gu
6,288,319 B1 9/2001 Catona
6,441,921 B1 8/2002 Soscia
6,453,300 B2 9/2002 Simpson
6,608,972 B1 8/2003 Lemelson et al.
6,816,679 B2 11/2004 Lemelson et al.
6,845,583 B2 * 1/2005 Lee ..... G09F 25/00 40/124.03
7,127,841 B1 10/2006 Weber
7,152,350 B2 12/2006 Youngdahl
7,205,473 B2 4/2007 Li et al.
7,356,154 B1 4/2008 Kotzin
7,356,950 B1 4/2008 Avery
7,603,802 B2 10/2009 Oudekerk et al.
8,312,652 B2 11/2012 Mayer et al.
2002/0105185 A1 8/2002 Cobb
2002/0139017 A1 * 10/2002 Pines ..... G09F 1/00 40/124.03
2003/0064353 A1 * 4/2003 Clapper ..... G06K 19/07 434/319
2003/0156686 A1 * 8/2003 Pines ..... B42D 15/022 379/67.1
2003/0182827 A1 10/2003 Youngdahl
2004/0066915 A1 * 4/2004 Turner ..... H04M 1/21 379/67.1
2004/0139318 A1 7/2004 Fiala et al.
2004/0204135 A1 10/2004 Zhao et al.
2005/0102867 A1 5/2005 Youngdahl
2006/0075033 A1 4/2006 Bienstock et al.
2006/0134591 A1 * 6/2006 Karat ..... B42D 15/022 434/308
2007/0082711 A1 4/2007 Zhao et al.
2007/0150082 A1 6/2007 Yang et al.
2007/0171278 A1 7/2007 Chen
2007/0238082 A1 10/2007 Ingrassia
2007/0256337 A1 11/2007 Segan
2007/0284269 A1 12/2007 Star
2008/0016731 A1 1/2008 Branch
2008/0275706 A1 11/2008 Paulini
2009/0126239 A1 * 5/2009 Clegg ..... B42D 15/022 40/124.03
2009/0132242 A1 5/2009 Wang et al.
2009/0161839 A1 6/2009 Neumann
2009/0281794 A1 11/2009 Ben-Haroush et al.
2010/0050486 A1 3/2010 Clegg et al.
2010/0052876 A1 3/2010 Clegg et al.
2010/0052934 A1 3/2010 Clegg et al.

* cited by examiner

GREETING CARD HAVING AUDIO RECORDING CAPABILITIES WITH TRIAL MODE FEATURE

CROSS-REFERENCE TO RELATED APPLICATIONS

This is a continuation application that claims priority benefit of co-pending U.S. patent application Ser. No. 12/101,789, filed Apr. 11, 2008, and entitled "Greeting Card Having Audio Recording Capabilities with Trial Mode Feature," the contents of which is incorporated herein by reference in the entirety.

STATEMENT REGARDING FEDERALLY SPONSORED RESEARCH OR DEVELOPMENT

Not applicable.

BRIEF SUMMARY OF THE INVENTION

The present invention relates to a greeting card with an audio recording component. More particularly, this invention relates to a greeting card having a user recordable audible message component that permits a giver of the greeting card to record a personal audio message on card to customize the greeting card prior to delivery to its intended recipient. The user recordable component includes a trial mode that permits potential consumers to try out the message recording component in a store where the greeting card is on display.

Paper greeting cards that play a prerecorded audio messages upon opening of the card have become well received by consumers. These cards typically play a portion of a song or an audio clip from a movie upon opening of the greeting card. In an effort to provide consumers with the ability to personalize and customize a sound card prior to its delivery to the intended recipient with more than personal written sentiment, the present invention permits users to record their own audio message to the greeting card that will be played upon opening of the card by the intended recipient. In one embodiment, the greeting card is already provided with a prerecorded and permanent recording, such as a song. The user is then permitted to record their own message to the card that is then played upon opening of the card as an introduction to or dedication of the prerecorded sound file. For example, the user could introduce the song that will follow the user's personal recording.

In another embodiment, the card is provided with a second prerecorded audio file that includes audible instructions to assist a user of the card in the process of recording of their own message. This instruction recording is played upon opening of the card when the card is in a trial mode. The trial mode permits a potential purchaser to sample the functionality of the greeting card by recording their own test message. The recorded test message is then automatically played back upon completion of the recording session. To avoid having greeting cards that play messages recorded by previous shoppers, the trial mode of the greeting card does not provide a manner by which a recorded test message may be played back a second time at a point subsequent to the automatic playback.

The greeting card also includes a use mode where a purchaser of the card may permanently record an audio message that can be subsequently played back at a later time. To provide this feature, the card is provided with a removable portion that switches the card from the trial mode to the use mode. This feature will be discussed in greater detail below.

Further objects, features and advantages of the present invention over the prior art will become apparent from the detailed description of the drawings which follows, when considered with the attached figures.

BRIEF DESCRIPTION OF THE SEVERAL VIEWS OF THE DRAWING

The features of the invention noted above are explained in more detail with reference to the embodiments illustrated in the attached drawing figures, in which like reference numerals denote like elements, in which FIGS. 1-7 illustrate one possible embodiment of the present invention, and in which:

FIG. 1 is a perspective view of an interior of a partially opened greeting card constructed in accordance with an embodiment of the present invention;

FIG. 2 is a side elevation of the interior of the greeting card of FIG. 1 with the greeting card in the fully open position;

FIG. 3 is a side elevation of the interior of the greeting card of FIG. 2 with a trial flap moved to the left and certain internal components of the greeting card illustrated in dashed lines;

FIG. 4 is a side elevation of the interior of the greeting card of FIG. 3 with a majority of a cover panel cut-away to reveal electrical components of the greeting card;

FIG. 5 is a fragmentary view of a portion of the greeting card of FIG. 4 with the trial flap partially removed;

FIG. 6 is a fragmentary view of a portion of the greeting card of FIG. 4 with the trial flap fully removed; and FIG. 7 is a fragmentary view of another portion of the greeting card of FIG. 4 with an instruction sticker partially removed.

DETAILED DESCRIPTION OF THE INVENTION

Figure 1:
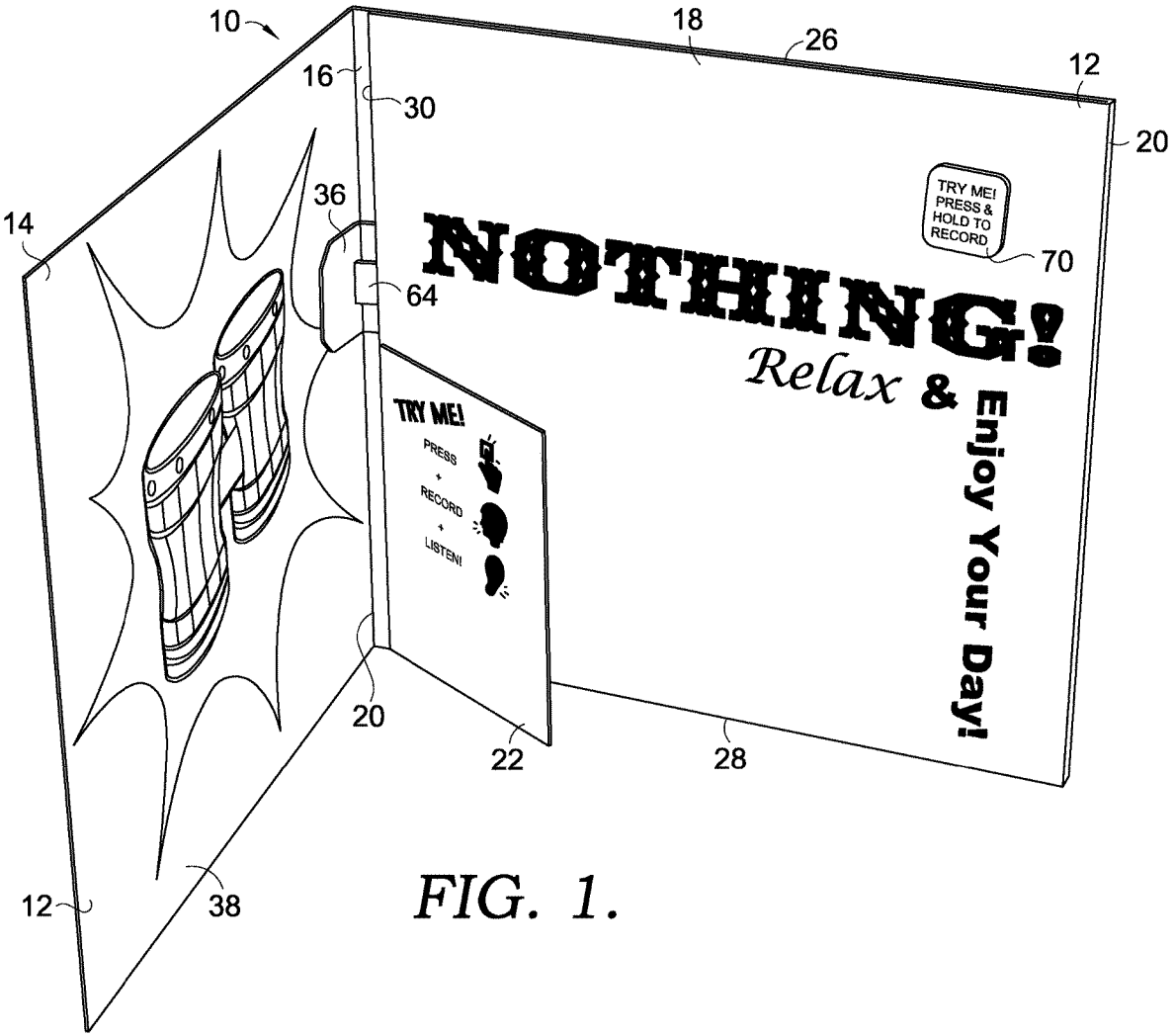
Figure 2:
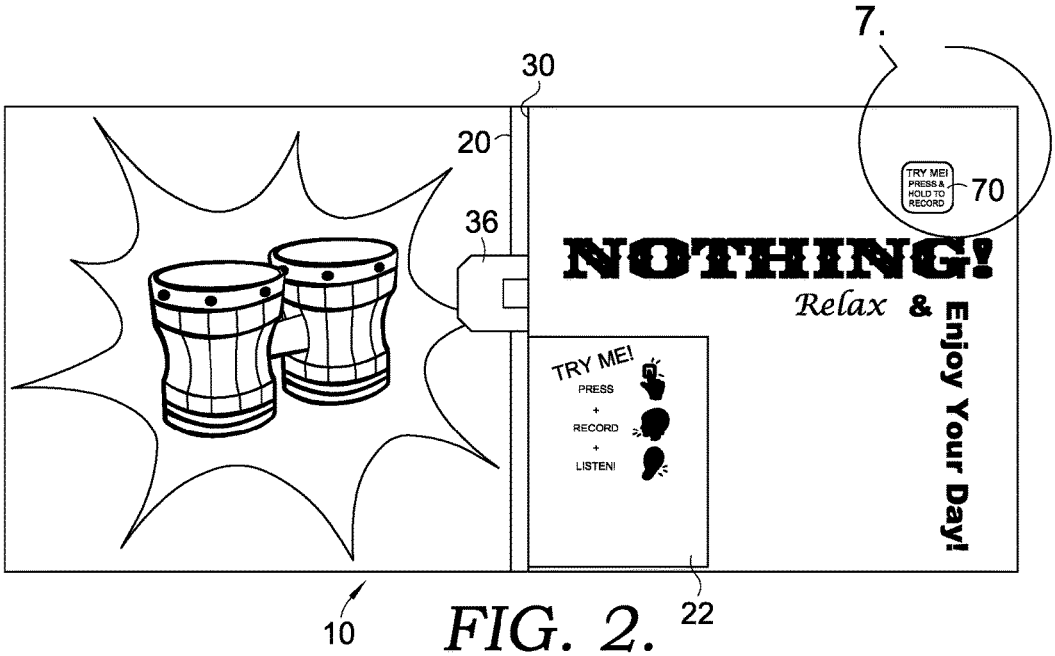
Figure 3:
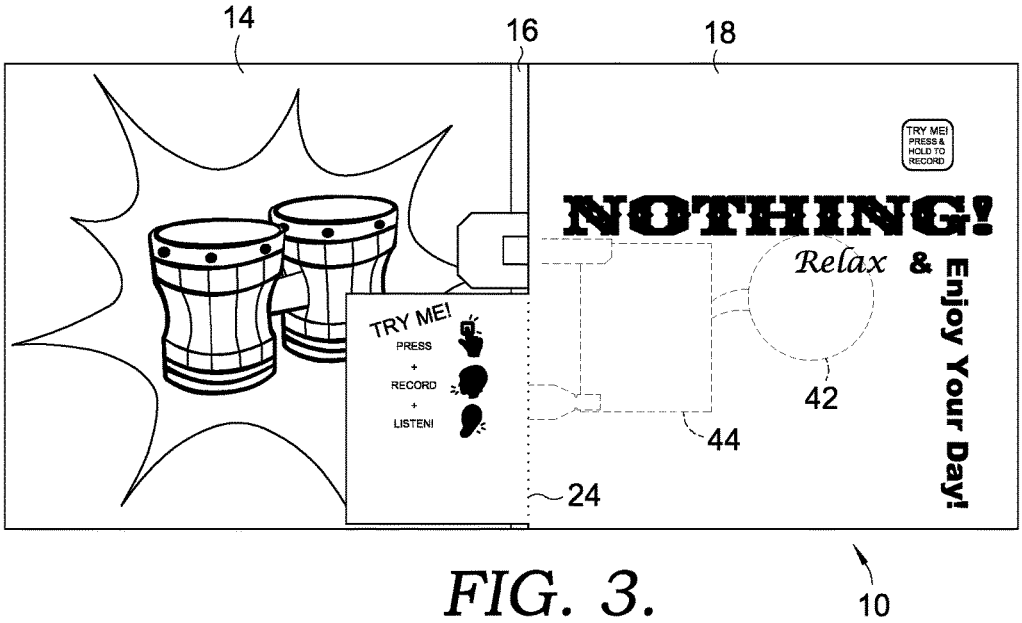

Referring now to the drawings in more detail and initially to FIG. 1, numeral 10 generally designates a greeting card constructed in accordance with an embodiment of the present invention. The greeting card 10 includes a card body 12. In the illustrated embodiment, the card body 12 includes a front panel 14, a back panel 16, and an interior panel 18. As readily understood by one of ordinary skill in the art, the card body 12 may consist of a single piece of card stock that has been folded along fold lines 20 to provide panels 14, 16 and 18, as depicted in the illustrated embodiment. It would also be readily understood that the panels 14, 16, 18 may be individual panels that are joined to one another and any number of methods known in the art and that the card body 12 could have any number of panels.

A trial mode panel or flap 22 is also provided and is preferably coupled with the card body 12. In the illustrated embodiment, the trial mode panel 22 is a part of and is cut out with the card blank that forms the card body 12. The fold line 20, however, between the trial mode panel 22 and the interior panel 18 is scored to provide a perforated tear line 24. The purpose of the tear line will be discussed in greater detail below.

In the illustrated embodiment, the interior panel 18 has been folded back such that it overlies the back panel 16. The interior panel 18 and the back panel 16 have been secured together along an upper edge 26 of the card body 12 and along a lower edge 28 of the card body 12. A right edge 30 of the card body 12 has been left unsecured to the back panel 16. As such, the interior panel 18 and the back panel 16 define a pocket or cavity 32 into which an audio message recording and playback device 34 may be positioned.

Figure 4:
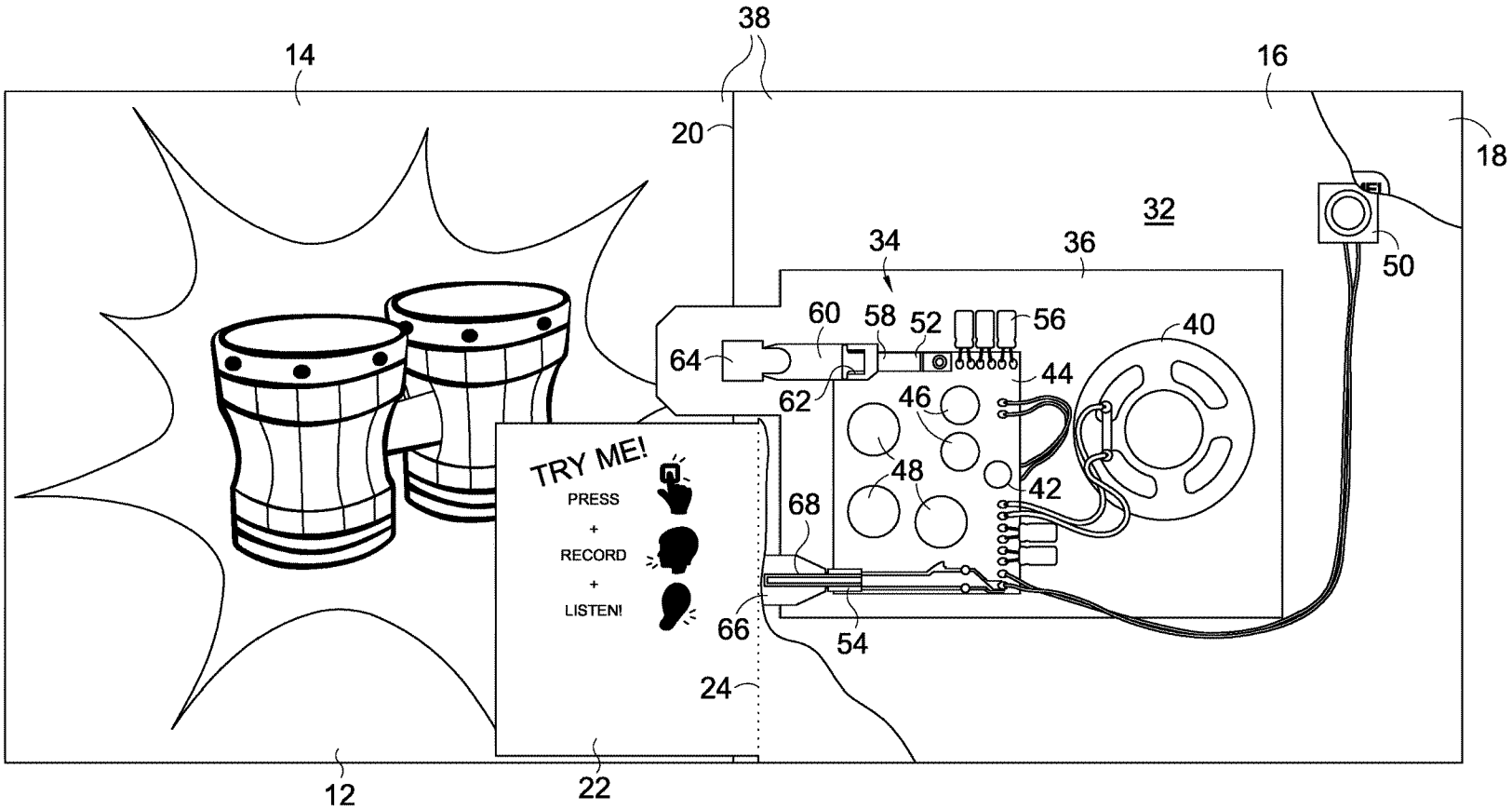
Figure 7:
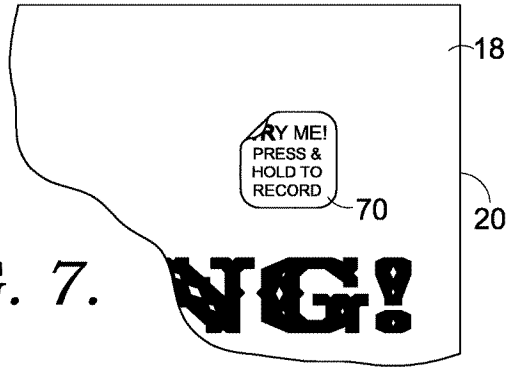

Turning now to FIG. 4, the audio device 34 is illustrated. The audio device 34, for ease of manufacture and assembly of the greeting card 10, may be provided on a carrier 36. The carrier 36 can then be adhered to inner surfaces 38 of the front and back panels 14, 16. Alternatively, the components of the audio device 34 may be individually positioned inside the pocket 32.

The audio device 34 preferably includes a speaker 40, a microphone 42, a circuit board 44, an integrated circuit 46, a power supply 48, and first, second and third switches 50, 52, and 54. In addition to the electrical components mentioned, which are coupled to the circuit board 44, other electrical components 56 are coupled with the circuit board 44 as would be readily understood and appreciated by one of ordinary skill in the art.

In the illustrated embodiment, the audio device 34 includes a separate speaker 40 and microphone 42. It is to be understood that the two separate devices could be replaced by one combination device and still be within the scope of the present invention. Similarly, in the illustrated embodiment the audio device 34 includes two separate integrated circuits 46. The two separate integrated circuits could be replaced by a single integrated circuit having the functionality discussed herein. Further still, in the illustrated embodiment, the power supply 48 is provided by three separate batteries 48. Other methods of powering the audio device 34 are known and within the scope of the present invention.

The first switch 50 is configured to provide the audio device 34 with activation of the recording feature of the audio device 34. Accordingly, in the illustrated embodiment, the first switch 50 is implemented as a record button 50. As would be understood by one of ordinary skill in the art, the pressing of the recorded button 50 initiates a recording session whereby a user may record their own audio message to the recording device 34 by way of the microphone 42. In the illustrated configuration, the recording sessions lasts as long as the record button 50 is depressed or until the capacity of the memory of the audio device 34 is reached.

The second switch 52, in the illustrated embodiment, has been implemented as a slide switch 52. The slide switch includes a contact arm 58 which is biased into engagement with a contact surface (not shown) on the circuit board 44. The slide switch 52 also includes a slide tab 60 that is movable between the first position partially illustrated in FIG. 1, where a portion of the slide tab 60 is intermediate the contact arm 58 and the contact surface of the circuit board 44, thereby creating an open circuit, and the second position illustrated in FIG. 4, where the greeting card 10 is in an open position and an aperture 62 in the slide tab 60 permits the contact arm 58 to abut the contact surface of the circuit board 44, thereby creating a closed circuit. A proximal end 64 of the slide tab 60 may be positioned over the inner surface 38 of the front panel 14 whereby movement of the front panel 14 away from the interior panel 18 (i.e., opening the card) pulls the slide tab 60 out from between the contact arm 58 and the contact surface of the circuit board 44 and whereby subsequent closing of the greeting card 10 (i.e., moving the front panel 14 towards the interior panel 18) moves the slide tab 60 back between the contact arm 58 and the contact surface of the circuit board 44.

Figure 6:
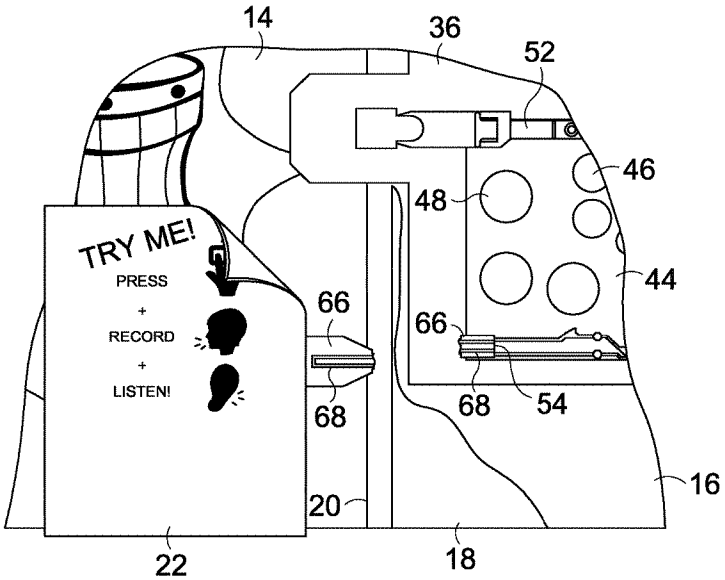

At the illustrated embodiment, the third switch 54 is implemented as a tear switch 54. The tear switch includes a strip 66 having a path 68 thereon. A portion of the strip 66 is coupled with the trial mode panel 22 and another portion of the strip is coupled with the circuit board 44. In the embodiment illustrated in FIG. 4 where the strip 66 is still one piece, electricity may flow from the circuit board 44 through the path 68 and return back to the circuit board 44, thereby informing the audio device 34 that the trial mode panel 22 is still in place and that the audio device 34 should function in its trial mode. When the trial mode panel 22 is detached from the greeting card 10, as illustrated in FIG. 6, the strip 66 is torn into two pieces and the path 68 is broken. As a result, the tear switch 54 is moved from a closed circuit to an open circuit, the change in the state of the tear switch 54 is recognized by the audio device 34, and the audio device 34 functions in a use mode.

When appearing in a store for sale, the greeting card 10 appears generally as illustrated in FIG. 1. In this condition (i.e., where the trial mode panel 22 is still coupled with the card body 12), the greeting card 10 is in its trial mode. In one embodiment of the trial mode, upon opening of the greeting card 10 as illustrated in FIG. 1, a first prerecorded and preferably permanent recording is played followed by a second prerecorded and permanent recording. In this embodiment, the first recording is an audio message containing spoken instructions regarding how to record a test message for playback. An example of a possible first message would be, "press and hold button to record your message before the song." In this embodiment, the first recording is immediately followed by the second recording. In this embodiment, the second recording is a song or music clip. In the illustrated embodiment, the song that correlates with the text and graphics (i.e., the sentiment) on the greeting card is the song "Bang The Drum All Day" by Todd Rundgren. Once the song is played, the audio device 34 waits for further user input. The trial mode panel 22 may also be provided with instruction text and/or graphics to inform the user how to record a test message.

To record the test message, the user presses the record button 50 to initiate a recording session. In the illustrated embodiment, a removable location label 70 is provided to visibly indicate the position of the record button 50 that is concealed in the pocket 32 between the interior panel 18 and the back panel 16. A user may choose to pinch the record button 50 between their thumb and a finger to initiate the record sequence.

Upon completion of recording a test message, the user releases the record button 50. At this point, the audio device 34 automatically initiates playback of the test message so that the user may hear their recording. To give the user/potential purchaser a more accurate understanding of what it would be like to receive the card, the test message is followed by playing of the second recording, in this case the song. Once the test message and the song have been played, the audio device 34 waits for subsequent user interaction. The trial mode does not provide a way for the test message to be played a second time. This prevents a situation where a first person in a store records an inappropriate message on the greeting card 10 and leaves it on the shelf to be subsequently played back to a second unsuspecting person at a later time upon opening the card. In this regard, upon closing the card 10 when it is in its trial mode, the audio device 34 reverts to its default procedures and subsequent opening of the card 10 results in playing of the instruction recording followed by the music recording.

A second instruction recording may be stored on the audio device 34 to further assist a user in recording a message. In one embodiment, the second message would be played immediately upon pressing of the record button 50. A sample second instruction recording is, "record your message after the beep. Beep." Though not necessary, preferably closing of the card turns off the instructions or music immediately. Similarly, depression of the record button 50 interrupts the first instruction recording or the music.

Figure 5:
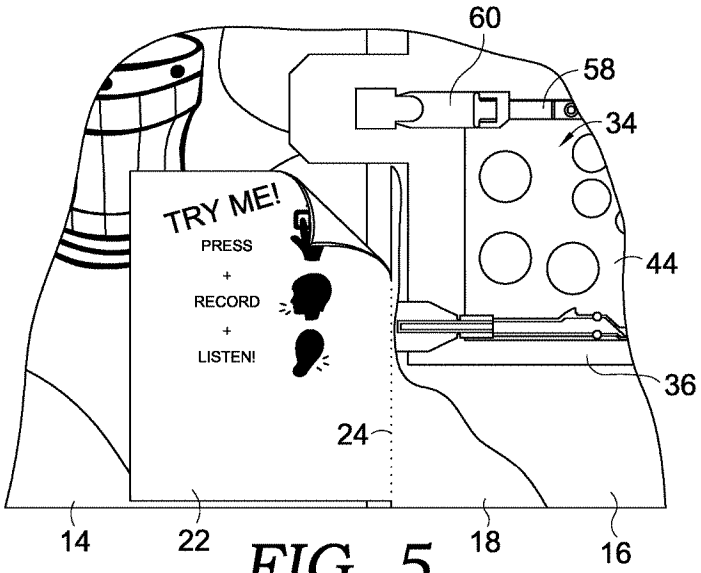

Once a person purchases the greeting card 10, they may switch the greeting card 10 from the trial mode to the use mode. This is done by tearing off and/or removing the trial mode panel 22 from the greeting card 10, as illustrated in FIGS. 5 and 6. Once the greeting card 10 has been put in the use mode, as illustrated in FIG. 6, the audio device 34 permits repeated playback of a user stored message upon activation of the audio device 34 by the second or slide switch 52 upon opening of the card 10. If the user desires to re-record a message prior to sending the card to the intended recipient, the user simply presses the record button 50 again to initiate another record session, thereby recording a new message over the old message. Once the user is satisfied with the message, the user may remove the label 70 and send the greeting card 10 to the intended recipient. Removal of the label 70 is not necessary; however, removal of the label 70 helps avoid the recipient accidentally recording over the message originally recorded and sent to them by the card sender. Similarly, the audio device 34 is configured to ignore activation of the record button 50 when the second switch 52 is in its open position (i.e., when the greeting card 10 is closed). This also prevents accidental recording over the intended message should the record button be pressed during the mailing process. It should be noted that, in the use mode, the first recording or the first instruction recording is not played initially upon opening of the greeting card 10. Instead, the user recorded message is played immediately upon opening of the card 10 followed by the second recording, which in the illustrated embodiment is a song.

Many variations can be made to the illustrated embodiment and/or discussed embodiments of the present invention without departing from the scope of the present invention. Such modifications are within the scope of the present invention. For example, the positions of the switches 50, 52, 54 can be inverted and the types of switches could be changed. For example, while the tear switch 54 presents a closed circuit in the trial mode and an open mode in the use mode, this could be switched such that removal of the trial mode panel 22 closes the third switch 54. Alternatively, different types of "switches" could be used as would be understood by one of ordinary skill in the art. The term "switches" is used in its broadest sense. Another possible modification would be replacing the slide switch 52 with a light detection mechanism such that opening of the card 10 is recognized by a change in light, thereby sending a signal to the audio device 34 to initiate a playback sequence. Further, while the user recorded message is followed by the pre-recorded/non-user recorded recording in one of the embodiments discussed above, it is within the scope of the present invention for the user recorded message to be played before, during and/or after the pre-recorded recording. Other modifications would be within the scope of the present invention.

From the foregoing it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. An audio greeting card comprising:

a card body having first, second and third panels, wherein adjacent panels are connected together; and an audio message recording and playback device coupled with the card body, the audio device having a microphone, a speaker, a battery, at least one recording stored therein, a first switch for initiating a message recording session, and a second switch, wherein the audio device has a trial mode and a use mode, wherein activation of the second switch initiates playing of the at least one recording in the trial mode, and wherein activation of the second switch initiates playback of a user recorded message and does not initiate playing of the at least one recording in the use mode.

2. The greeting card of claim 1, wherein the at least one recording stored in the audio message recording and playback device is a permanently recorded, prerecorded, non-user recorded recording.

3. The greeting card of claim 2, wherein the recorded message is a message stored in the audio message recording and playback device that was previously recorded by a user during the message recording session.

4. The greeting card of claim 3, wherein the recorded message is automatically played subsequent to the message recording session in the trial mode.

5. The greeting card of claim 1, wherein the card body is formed of a single unitary card blank, wherein the panels are defined by folds in the card blank, wherein the first and second panels are separated by a first fold line, wherein the second and third panels are separated by a second fold line, wherein the third panel is folded over and secured with the second panel, thereby creating a pocket, and wherein the audio device is positioned within the pocket.

6. The greeting card of claim 1, wherein the first panel is pivotable with respect to the second panel between a closed position, where the first panel overlies the second panel, and an open position, wherein movement of the first panel from the closed position to the open position activates the second switch.

7. The greeting card of claim 1, wherein the audio message recording and playback device further includes a third switch, wherein the position of the third switch determines whether the audio message recording and playback device is in the trial mode or the use mode.

8. An audio message recording and playback device with a trial feature, the audio device comprising:

a circuit board;

a plurality of electrical components coupled with the circuit board, the components including a speaker, a microphone, a battery, an integrated circuit, and first, second and third switches;

a recording stored in the audio device;

wherein activation of the first switch initiates a message recording session, whereby a user may record a message and the user recorded message is stored in the audio device;

wherein activation of the second switch initiates playing of one of the recording and the user recorded message stored in the audio device; and wherein the third switch is movable from a first state to a second state, wherein the audio device operates in a first mode when the third switch is in its first state, wherein the audio device operates in a second mode when the third switch is in its second state, wherein activation of the second switch initiates playing of the recording and does not initiate playing of the user recorded message when the audio device is in the first mode, and wherein activation of the second switch initiates playing of the user recorded message when the audio device is in the second mode.

9. The audio device of claim 8, wherein the recording includes audible instructions regarding operation of the audio device, wherein the recording with instructions is played upon activation of the second switch when the audio device is in the first mode, and wherein the recording with instructions is not played upon activation of the second switch when the audio device is in the second mode.

10. The audio device of claim 9, further comprising a second recording stored in the audio device, wherein the second recording is automatically played following one of the recording and the user recorded message stored in the audio device.

11. The audio device of claim 8, wherein the user recorded message is played back automatically upon completion of the message recording session, wherein the user recorded message is prohibited from additional playback when the audio device is in the first mode, and wherein the user recorded message is permitted additional playback when the audio device is in the second mode upon subsequent activation of the second switch.

12. An audio greeting card comprising:

a card body having first, second and third panels, wherein adjacent panels are connected together; and an audio message recording and playback device coupled with the card body, the audio device having a microphone, a speaker, a battery, a prerecorded message stored therein, a first switch for initiating a message recording session where a user may record a user recorded message, and a second switch, wherein the audio device has a trial mode where the prerecorded message may be played by the second switch, and wherein the audio device has a use mode where the user recorded message may be played by the second switch more than once.

13. The greeting card of claim 12, wherein the prerecorded message stored in the audio message recording and playback device is a permanently recorded, prerecorded, non-user recorded recording.

14. The greeting card of claim 13, wherein the prerecorded message includes audio instructions that tell a user how to initiate a message recording session.

15. The greeting card of claim 13, wherein the prerecorded message is automatically played subsequent to the message recording session in the trial mode.

16. The greeting card of claim 12, wherein the user recorded message may only be played once in the trial mode and wherein the user recorded message may be played more than once in the use mode.

17. The greeting card of claim 12, wherein the prerecorded message may not be played in the use mode.

18. The greeting card of claim 12, wherein the user recorded message is automatically played back once upon conclusion of a message recording session and may not be played back again in the trial mode, and wherein the user recorded message may be played back multiple times in the use mode by multiple activations of the second switch.

19. The greeting card of claim 12, wherein the first panel is pivotable with respect to the second panel between a closed position, where the first panel overlies the second panel, and an open position, wherein movement of the first panel from the closed position to the open position activates the second switch.

20. The greeting card of claim 12, wherein the audio message recording and playback device further includes a third switch, wherein the position of the third switch determines whether the audio message recording and playback device is in the trial mode or the use mode.

* * * * *